US011015586B2

(12) United States Patent
Shibata et al.

(10) Patent No.: US 11,015,586 B2
(45) Date of Patent: May 25, 2021

(54) SHOE AND SWASH PLATE COMPRESSOR INCLUDING THE SHOE

(71) Applicant: TAIHO KOGYO CO., LTD., Toyota (JP)

(72) Inventors: Masato Shibata, Toyota (JP); Shingo Goto, Toyota (JP); Yasuyuki Tago, Toyota (JP)

(73) Assignee: TAIHO KOGYO CO., LTD., Toyota (JP)

( * ) Notice: Subject to any disclaimer, the term of this patent is extended or adjusted under 35 U.S.C. 154(b) by 114 days.

(21) Appl. No.: 16/087,877

(22) PCT Filed: Mar. 30, 2017

(86) PCT No.: PCT/JP2017/013447
§ 371 (c)(1),
(2) Date: Sep. 24, 2018

(87) PCT Pub. No.: WO2017/170954
PCT Pub. Date: Oct. 5, 2017

(65) Prior Publication Data

US 2019/0113030 A1 Apr. 18, 2019

(30) Foreign Application Priority Data

Mar. 31, 2016 (JP) ..... JP2016-073126

(51) Int. Cl.
*F04B 27/08* (2006.01)
*F04B 27/10* (2006.01)

(52) U.S. Cl.
CPC ..... *F04B 27/0886* (2013.01); *F04B 27/109* (2013.01); *F04B 27/1072* (2013.01); *F05C 2253/20* (2013.01)

(58) Field of Classification Search
CPC ..... F04B 27/0882; F04B 27/0886; F04B 39/0292; F04B 27/1072; F04B 27/109; F05C 2253/20
(Continued)

(56) References Cited

U.S. PATENT DOCUMENTS 4,568,252 A * 2/1986 Hattori ..... F04B 27/0886 417/269
5,483,867 A 1/1996 Ikeda et al.
(Continued)

FOREIGN PATENT DOCUMENTS

CN 1138068 2/2004
CN 201068848 6/2008
(Continued)

OTHER PUBLICATIONS

Extended European Search Report issued in corresponding European Patent Application No. 17775488.4, dated Aug. 19, 2019 (9 pages).
(Continued)

*Primary Examiner* — Alexander B Comley
(74) *Attorney, Agent, or Firm* — Buchanan Ingersoll & Rooney PC

(57) ABSTRACT

There is provided a shoe capable of suppressing deformation of a member on which the shoe slides. The shoe includes: a first sliding surface which slides on a concave surface of a piston (first movable member); and a second sliding surface which bulges toward a side opposite to the first sliding surface and slides on a flat surface of a swash plate (second movable member). The second sliding surface includes: a curved outer peripheral portion which is provided along an outer periphery of the second sliding surface; and a central portion which is provided at a center of the second sliding surface so as to be continuous with the curved outer periph-
(Continued)

eral portion and has a radius of curvature greater than a radius of curvature of the curved outer peripheral portion.

2 Claims, 7 Drawing Sheets

(58) Field of Classification Search
USPC ..... 417/269–272
See application file for complete search history.

(56) References Cited

U.S. PATENT DOCUMENTS

| | | | | |
|---|---|---|---|---|
| 5,896,803 | A * | 4/1999 | Sugawara | F04B 27/0886 92/12.2 |
| 6,378,415 | B1 * | 4/2002 | Sugiura | F04B 27/0886 92/155 |
| 2002/0155004 | A1 * | 10/2002 | Fukanuma | F04B 27/0886 417/71 |

FOREIGN PATENT DOCUMENTS

| | | | |
|---|---|---|---|
| CN | 101868622 | | 10/2010 |
| EP | 0 890 742 | A2 | 1/1999 |
| EP | 1 188 923 | A2 | 3/2002 |
| JP | 57049081 | A | 3/1982 |
| JP | 57051977 | A | 3/1982 |
| JP | 11022640 | A | 1/1999 |
| JP | 2002089438 | A | 3/2002 |

OTHER PUBLICATIONS

International Search Report (with English Translation) and Written Opinion issued in International Patent Application No. PCT/JP2017/013447, 8 pages (dated May 16, 2017).

Office Action issued in corresponding Chinese Patent Application No. 201780021031.7, dated Apr. 17, 2019 (6 pages).

* cited by examiner

SHOE AND SWASH PLATE COMPRESSOR INCLUDING THE SHOE

TECHNICAL FIELD

The present invention relates to techniques of a shoe and a swash plate compressor including the shoe.

BACKGROUND ART

Conventionally, techniques of a shoe and a swash plate compressor including the shoe are known. For example, the techniques are disclosed in Patent Literature 1.

Patent Literature 1 discloses a shoe (slider) used for a swash plate compressor. The shoe includes a spherical portion sliding on a recess provided in a piston, and a flat portion sliding on a surface of a swash plate. The flat portion of the shoe is a smooth convex surface having an extremely great radius of curvature. The apex of the flat portion is located at the center, and the height of the flat portion is not greater than 15 μm.

Due to such a configuration, a wedge-shaped gap is formed between the shoe and the swash plate such that the angle between the flat portion of the shoe and the surface of the swash plate smoothly decreases toward the center of the flat portion. Therefore, even in the case of a severe lubrication condition in which the feed amount of lubricant is small (during a low-speed operation), the lubricant is drawn into the gap by a wedge effect and an oil film is easily formed. Thus, seizure is prevented.

However, the technique disclosed in Patent Literature 1 has the following problem. In a case where the swash plate is made of a soft material such as a synthetic resin, particularly under high load, the surface of the swash plate easily deforms along the flat portion of the shoe. If the surface of the swash plate deforms along the flat portion of the shoe, the wedge-shaped gap disappears and therefore the wedge effect cannot be obtained.

CITATION LIST

Patent Literature

Patent Literature 1: JP 57-49081 A

SUMMARY OF INVENTION

Technical Problem

The present invention has been made in view of the above circumstances, and the problem to be solved by the present invention is to provide a shoe capable of suppressing deformation of a member on which the shoe slides.

Solution to Problem

The problem to be solved by the present invention is as described above. Next, means for solving the problem will be described.

That is, the shoe according to the present invention includes: a first sliding surface which slides on a concave surface of a first movable member; and a second sliding surface which bulges toward a side opposite to the first sliding surface and slides on a flat surface of a second movable member. The second sliding surface includes a curved outer peripheral portion which is provided along an outer periphery of the second sliding surface, and a central portion which is provided at a center of the second sliding surface so as to be continuous with the curved outer peripheral portion and has a radius of curvature greater than a radius of curvature of the curved outer peripheral portion.

In addition, the central portion has a diameter of not less than 5 mm and a bulging height of not greater than 3 μm.

In addition, the second sliding surface has a bulging height of not greater than 15 μm.

A swash plate compressor according to the present invention includes: the shoe; and a swash plate which is the second movable member and has a resin coating layer provided on the flat surface.

Advantageous Effects of Invention

The effects of the present invention are as follows.

According to the shoe of the present invention, deformation of the member (second movable member) on which the shoe slides can be suppressed.

According to the shoe of the present invention, deformation of the member (second movable member) on which the shoe slides can be further suppressed.

According to the shoe of the present invention, even in the case of a severe lubrication condition in which the feed amount of lubricant is small, an oil film can be easily formed on the second sliding surface.

According to the swash plate compressor of the present invention, deformation of the swash plate can be suppressed even if the resin coating layer is formed on the flat surface of the swash plate.

BRIEF DESCRIPTION OF DRAWINGS

FIG. 6(*b*) is a plan view of the shoe according to the one embodiment of the present invention.

FIG. 7(*b*) is a side view conceptually illustrating a sliding portion between the second sliding surface of the shoe and the swash plate according to the one embodiment of the present invention.

DESCRIPTION OF EMBODIMENT

Figure 1:
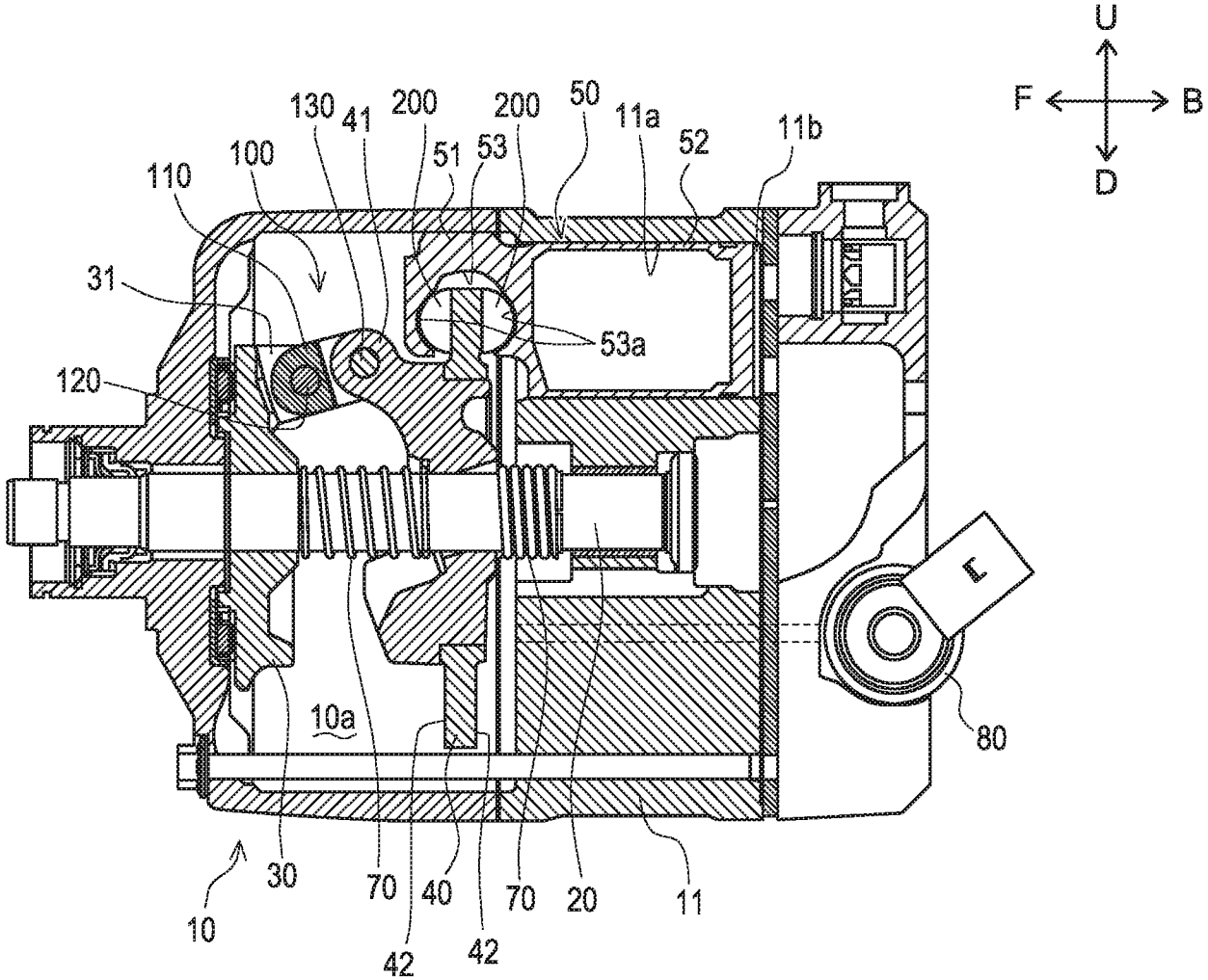
FIG. 1 is a side cross-sectional view illustrating an overall configuration of a swash plate compressor in which a shoe according to one embodiment of the present invention is used.

In the following, a description will be given where directions indicated by arrows U, D, F, B, L, and R in the drawings are defined as up, down, front, rear, left, and right directions, respectively.

First, an outline of the configuration of a swash plate compressor 1 will be described with reference to FIGS. 1 to 5.

The swash plate compressor 1 is a swash plate compressor used for, for example, an air conditioner for a vehicle. The swash plate compressor 1 mainly includes a housing 10, a rotating shaft 20, a rotor 30, a swash plate 40, a piston 50, a shoe 200, a spring 70, a control valve 80, and a transmission mechanism 100.

The housing 10 illustrated in FIG. 1 has a substantially box shape. A crank chamber 10*a* is provided inside the housing 10. A cylinder block 11 is provided in a middle portion in the front-rear direction of the housing 10.

A cylinder bore 11*a* is formed in the cylinder block 11. The cylinder bore 11*a* has a circular cross-section whose axial direction is oriented in the front-rear direction. Note that even though only one cylinder bore 11*a* is illustrated in FIG. 1, a plurality of cylinder bores 11*a* are formed at intervals in the circumferential direction. In the cylinder bore 11*a*, a compression chamber 11*b* is formed behind the piston 50 to be described later.

The rotating shaft 20 illustrated in FIGS. 1 to 4 is disposed such that the axial direction of the rotating shaft 20 is oriented in the front-rear direction. The rotating shaft 20 is rotatably supported at the central portion of the housing 10. One end portion (front end portion) of the rotating shaft 20 is connected to a driving source, not illustrated. On the rotating shaft 20, an annular plate-shaped retaining ring 21 is provided. The retaining ring 21 is fixed to a rear portion of the rotating shaft 20.

The rotor 30 illustrated in FIGS. 1 to 4 is a substantially disk-shaped member whose axial direction is oriented in the front-rear direction. The rotor 30 is fixed to the rotating shaft 20 such that the axial direction of the rotor 30 coincides with the axial direction of the rotating shaft 20. Therefore, the rotor 30 can integrally rotate with the rotating shaft 20. The rotor 30 includes a rotor-side arm 31.

The rotor-side arm 31 is provided on the rear portion (side facing the swash plate 40) of the rotor 30. The rotor-side arm 31 protrudes rearward from the rotor 30. The rotor-side arm 31 is integrally formed with the rotor 30 at the rear portion of the rotor 30. Two rotor-side arms 31 are formed at intervals in the circumferential direction of the rotor 30 (see FIG. 4).

The swash plate 40 is a member having a circular plate shape. The rotating shaft 20 is inserted through the center portion of the swash plate 40. The swash plate 40 is provided at a middle portion in the front-rear direction of the rotating shaft 20. The swash plate 40 is provided behind the rotor 30. The swash plate 40 is supported so as to be slidable in the front-rear direction and tiltable back and forth with respect to the rotating shaft 20. Note that even though the swash plate 40 is not fixed to the rotating shaft 20, the swash plate 40 rotates in conjunction with rotation of the rotating shaft 20 (rotor 30) by the transmission mechanism 100 to be described later. The swash plate 40 includes a swash plate-side arm 41. In addition, a resin coating layer 42 is formed on the swash plate 40.

The swash plate-side arm 41 is provided on the front portion (side facing the rotor 30) of the swash plate 40. The swash plate-side arm 41 protrudes substantially forward from the swash plate 40. The swash plate-side arm 41 is disposed between the two rotor-side arms 31 in the circumferential direction.

Figure 5:
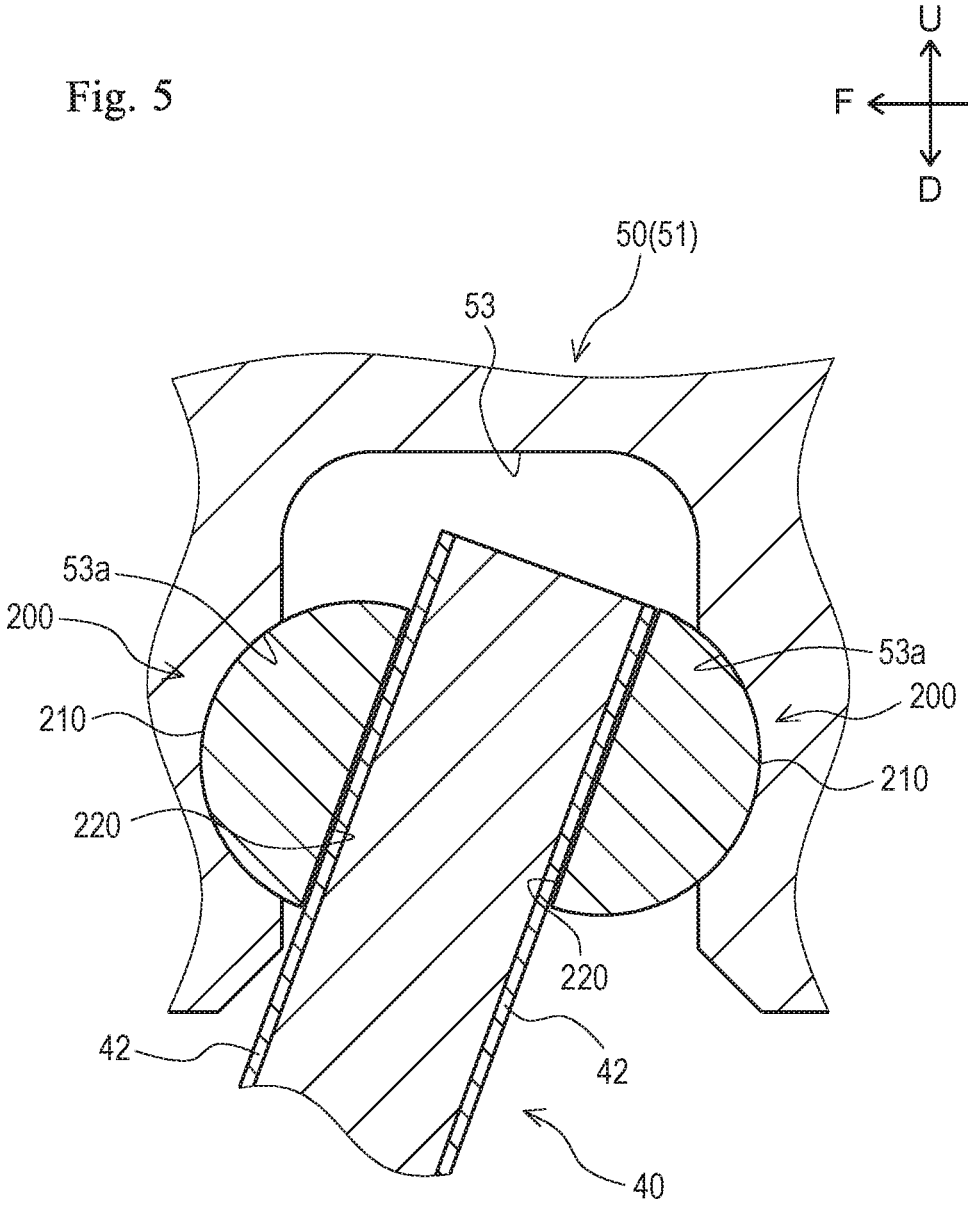
FIG. 5 is a side cross-sectional view (partially enlarged view) illustrating an engaging portion between a swash plate and a piston.

The resin coating layers 42 illustrated in FIGS. 1 and 5 cover the plate surfaces on both sides of the swash plate 40. The resin coating layer 42 is formed of an appropriate synthetic resin material in consideration of wear resistance and low friction property. Since the resin coating layer 42 is formed, in a case where both the swash plate 40 and the shoe 200 are formed of metals, it is possible to prevent the metals from being brought into sliding contact with each other.

The piston 50 illustrated in FIGS. 1 and 5 slides in the cylinder bore 11*a* formed in the cylinder block 11. The piston 50 mainly includes an engaging portion 51 and a head portion 52.

The engaging portion 51 constitutes the front portion of the piston 50. A cutout portion 53 is formed in the engaging portion 51.

The cutout portion 53 is formed such that the side portion on a radially inner side of the engaging portion 51 is cut out in a middle portion in the front-rear direction of the engaging portion 51. The cutout portion 53 is provided across the outer peripheral end portion of the swash plate 40. On side surfaces of the cutout portion 53, a pair of recesses are formed. In the pair of recesses, the shoes 200 to be described later are housed. Each of the pair of recesses has a spherical cap shape. The pair of recesses are provided so as to face each other in the front-rear direction. A concave surface 53*a* on which the shoe 200 slides is formed in the recess.

The head portion 52 constitutes the rear portion of the piston 50. The head portion 52 is disposed so as to be slidable in the cylinder bore 11*a*. The head portion 52 is formed behind the engaging portion 51. The head portion 52 has a circular cross-section whose axial direction is oriented in the front-rear direction. The outer diameter of the head portion 52 is formed to be substantially equal to the inner diameter of the cylinder bore 11*a*.

The shoe 200 illustrated in FIGS. 1 and 5 is configured to engage the swash plate 40 and the piston 50 with each other. The shoe 200 has a substantially hemispherical shape. The shoe 200 is housed in the recess formed in the cutout portion 53 of the piston 50. The shoe 200 is disposed at each of the front and rear of the outer peripheral end portion of the swash plate 40 (see FIG. 5). Details of the configuration of the shoe 200 will be described later.

The spring 70 illustrated in FIG. 1 energizes the swash plate 40. The spring 70 is a compression spring. The rotating shaft 20 is inserted through the central portion of the spring 70. The spring 70 is disposed at each of the front of and the rear of the swash plate 40 in a state where the extending/contracting direction of the spring 70 is oriented in the front-rear direction. As a result, the springs 70 energize the swash plate 40 from the front and the rear.

The control valve 80 illustrated in FIG. 1 adjusts the internal pressure of the crank chamber 10*a*. The control valve 80 is disposed at the rear of the housing 10.

Figure 2:
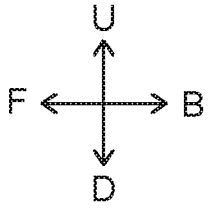
FIG. 2 is a side view illustrating a transmission mechanism.
Figure 2:
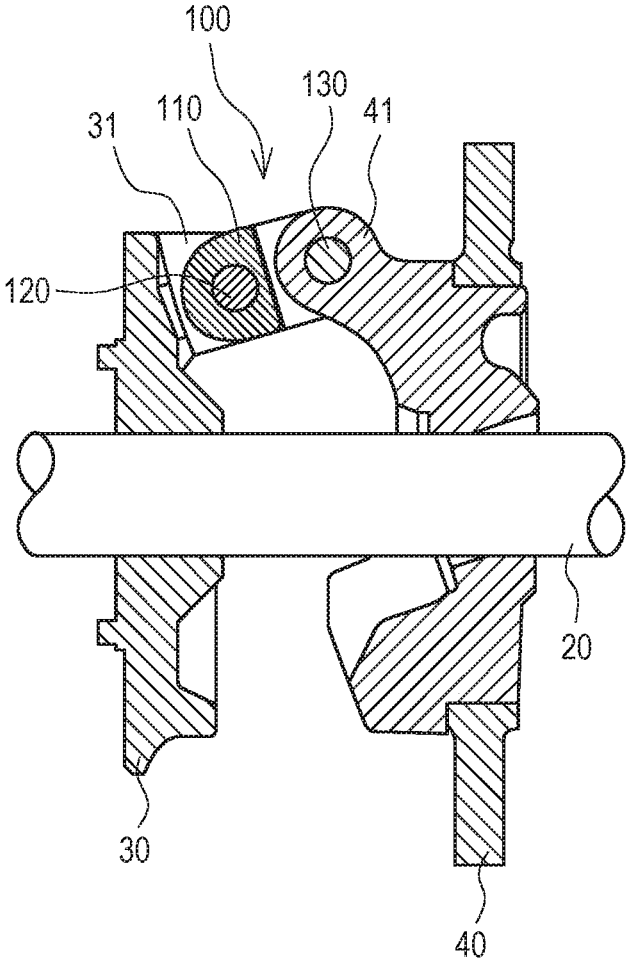
Figure 3:
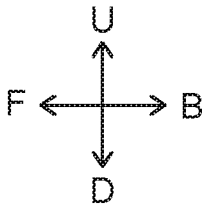
FIG. 3 is a side view illustrating a transmission mechanism at maximal discharge capacity.
Figure 3:
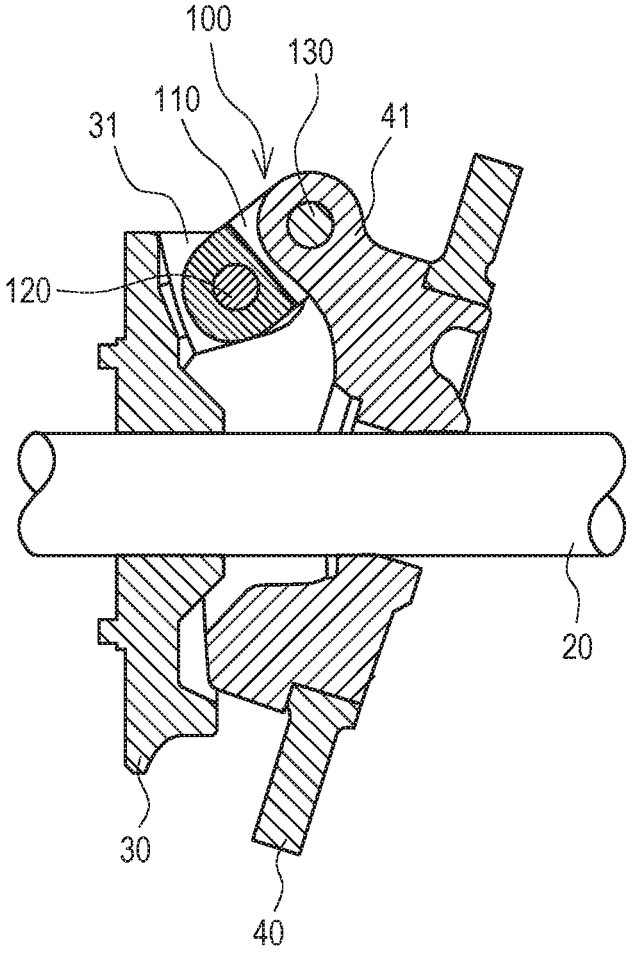
Figure 4:
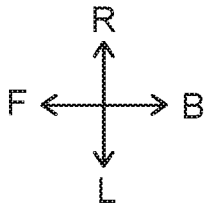
FIG. 4 is a plan view illustrating the transmission mechanism.
Figure 4:
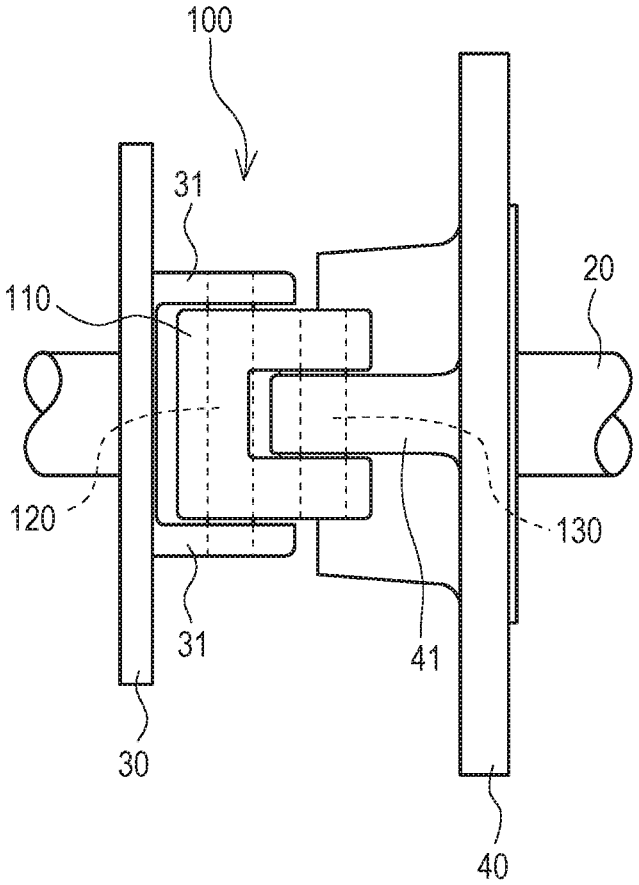

The transmission mechanism 100 rotates the swash plate 40 in conjunction with rotation of the rotor 30. In addition, the transmission mechanism 100 guides tilting movement of the swash plate 40. Note that each of FIGS. 1, 2 and 4 illustrates a state where the discharge capacity of the swash plate compressor 1 is minimal, and FIG. 3 illustrates a state where the discharge capacity of the swash plate compressor 1 is maximal.

The transmission mechanism 100 illustrated in FIGS. 1 to 4 is configured to connect the rotor 30 and the swash plate 40. The transmission mechanism 100 mainly includes a connecting arm 110, a rotor-side connecting pin 120, and a swash plate-side connecting pin 130.

The connecting arm 110 is a portion of the transmission mechanism 100, the portion connecting the rotor-side arm 31 and the swash plate-side arm 41. The connecting arm 110 is formed like a block extending substantially in the front-rear direction. The front portion of the connecting arm 110 is disposed between the two rotor-side arms 31. The rear portion of the connecting arm 110 is divided into two in the circumferential direction. The front end portion of the swash plate-side arm 41 is disposed between the divided portions of the connecting arm 110.

The rotor-side connecting pin 120 rotatably connects the rotor-side arm 31 and the connecting arm 110. The rotor-side connecting pin 120 has a substantially columnar shape extending in the right-left direction. The rotor-side connecting pin 120 is rotatably inserted through the two rotor-side arms 31 and the connecting arm 110. As a result, the rotor-side arms 31 and the connecting arm 110 are connected to each other in a state where the rotor-side arms 31 and the connecting arm 110 are relatively rotatable about the rotor-side connecting pin 120.

The swash plate-side connecting pin 130 rotatably connects the swash plate-side arm 41 and the connecting arm 110. The swash plate-side connecting pin 130 has a substantially columnar shape extending in the right-left direction. The swash plate-side connecting pin 130 is rotatably inserted through the rear portion (portion divided into two) of the connecting arm 110 and the swash plate-side arm 41. As a result, the swash plate-side arm 41 and the connecting arm 110 are connected to each other in a state where the swash plate-side arm 41 and the connecting arm 110 are relatively rotatable about the swash plate-side connecting pin 130.

Figure 6A:
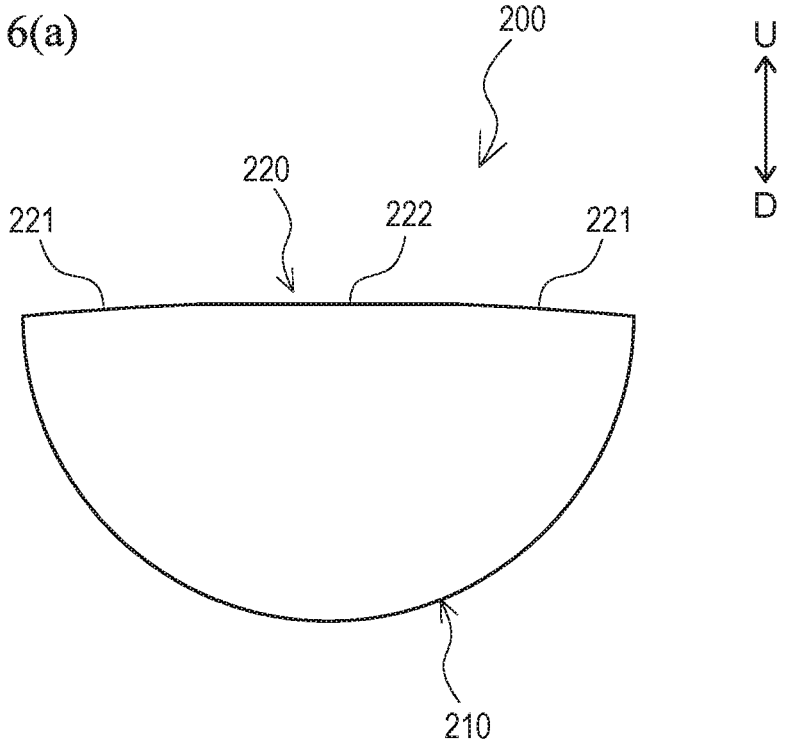
FIG. 6(*a*) is a side view of the shoe according to the one embodiment of the present invention.
Figure 6B:
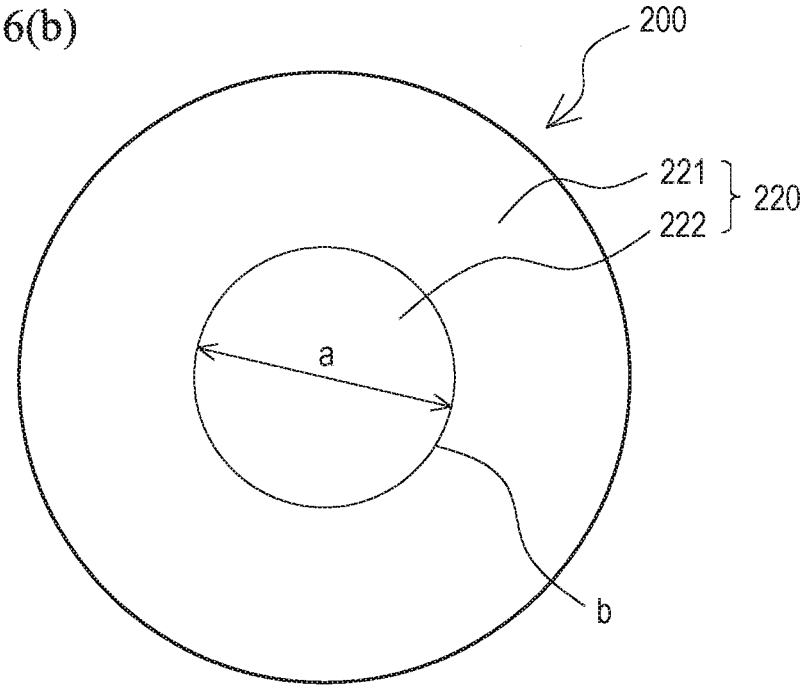
Figure 7A:
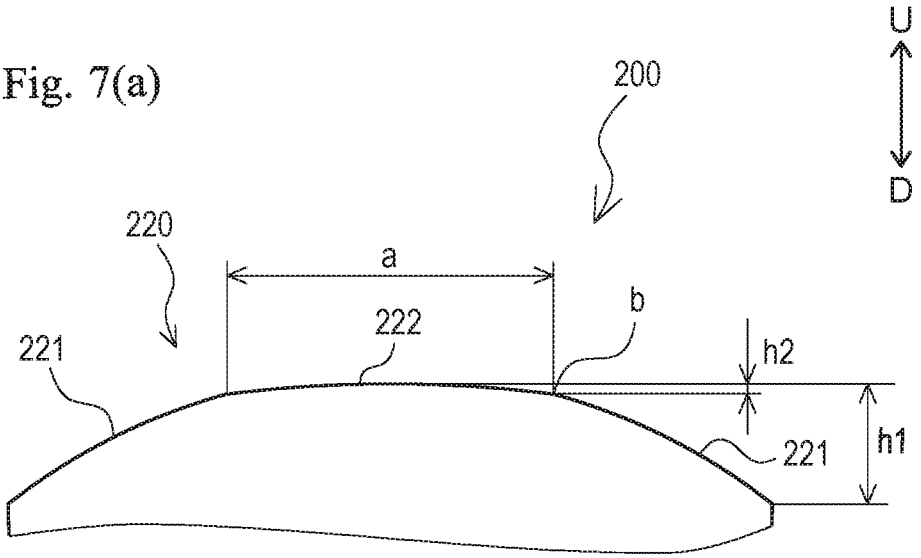
FIG. 7(*a*) is a side view conceptually illustrating a second sliding surface of the shoe according to the one embodiment of the present invention.
Figure 7B:
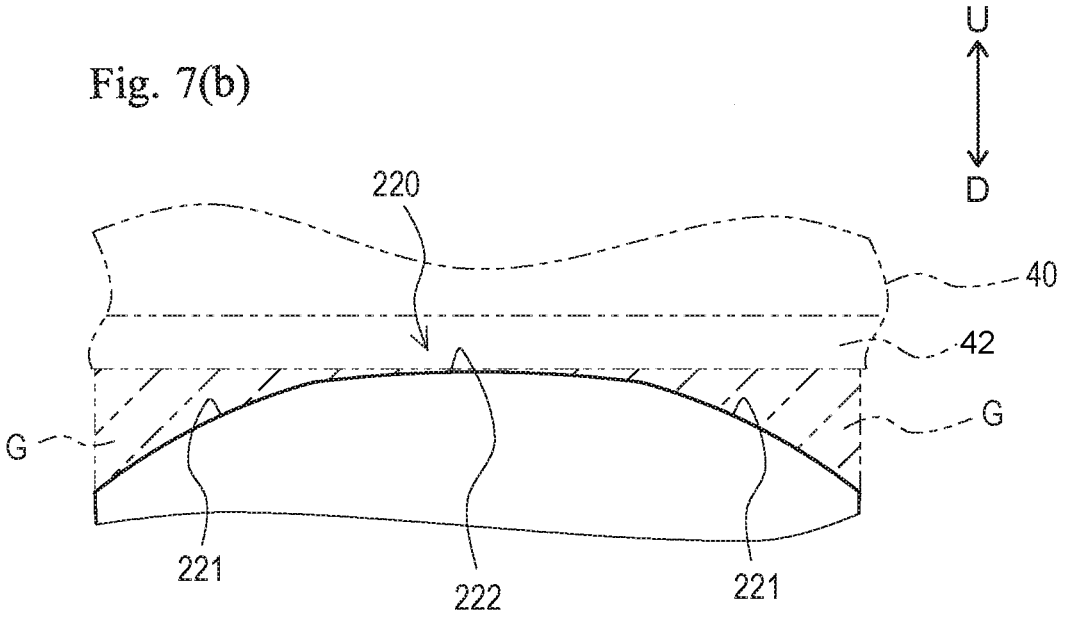

Hereinafter, the configuration of the shoe 200 will be described in detail with reference to FIGS. 6(*a*) to 7(*b*). Note that the definitions of the directions illustrated in FIGS. 6(*a*) to 7(*b*) differ from the definitions of the directions illustrated in FIGS. 1 to 5. In addition, FIG. 7 is a conceptual view emphasizing the vertical direction (up-down direction) more than the horizontal direction in order to facilitate understanding of the shape of the second sliding surface 220.

As described above, the shoe 200 is configured to engage the swash plate 40 and the piston 50. The shoe 200 includes a first sliding surface 210 and a second sliding surface 220.

The first sliding surface 210 is a lower surface of the shoe 200 and is a surface (see FIG. 5) sliding on the concave surface 53*a* of the piston 50. The first sliding surface 210 bulges downward. The first sliding surface 210 has a hemispherical shape along the concave surface 53*a* of the piston 50.

The second sliding surface 220 is an upper surface of the shoe 200 and is a surface (see FIG. 5) sliding on the flat surface (more specifically, the resin coating layer 42) of the swash plate 40. The second sliding surface 220 bulges upward, that is, to the side opposite to the first sliding surface 210. The second sliding surface 220 has a shape (shape closer to a flat shape) in which the distance in the up-down direction is smaller than that in the first sliding surface 210. The second sliding surface 220 has an outer peripheral portion 221 and a central portion 222.

The outer peripheral portion 221 constitutes the outer portion of the second sliding surface 220. The outer peripheral portion 221 is provided along the outer periphery (entire periphery) of the second sliding surface 220 in plan view. The outer peripheral portion 221 has a curved shape (spherical zone shape) whose radius of curvature is extremely greater than that of the first sliding surface 210.

The central portion 222 constitutes the inner portion (central portion in plan view) of the second sliding surface 220. The central portion 222 has a circular shape in plan view. The central portion 222 is provided continuously with the outer peripheral portion 221 on the inner side of the outer peripheral portion 221 (at the center of the second sliding surface 220). The central portion 222 has a substantially flat shape. More specifically, the central portion 222 has a flat shape or a curved shape (spherical cap shape) whose radius of curvature is greater than that of the outer peripheral portion 221.

The central portion 222 is formed over a range of not less than 5 mm in diameter on the second sliding surface 220. That is, the central portion 222 has a circular shape with a diameter a of not less than 5 mm in plan view. In addition, a height h2 (that is, the bulging height of the central portion 222) from a boundary b between the central portion 222 and the outer peripheral portion 221 to the apex (uppermost portion) of the central portion 222 is not greater than 3 μm. Since the diameter a and the bulging height h2 of the central portion 222 are defined in this manner, the central portion 222 has a flatter shape. A height h1 from the outer peripheral edge of the outer peripheral portion 221 to the apex of the central portion 222 (that is, the bulging height of the second sliding surface 220) is not greater than 15 μm.

In the swash plate compressor 1 (see FIG. 1) configured as described above, when the rotating shaft 20 is rotated by the driving source, not illustrated, the rotor 30 rotates integrally with the rotating shaft 20 about the axis of the rotating shaft 20. Then, the rotor-side arm 31 provided on the rotor 30 rotates about the axis of the rotating shaft 20 in a similar manner.

When the rotor-side arm 31 rotates, the side surface (inner surface in the right-left direction) of the rotor-side arm 31 and the side surface (outer surface in the right-left direction) of the connecting arm 110 are brought into contact with each other to engage with each other. As a result, rotational force of the rotor 30 is transmitted to the connecting arm 110. In addition, the side surface (inner surface in the right-left direction) of the connecting arm 110 and the side surface (outer surface in the right-left direction) of the swash plate-side arm 41 are brought into contact with each other to engage with each other. As a result, rotational force of the connecting arm 110 is transmitted to the swash plate-side arm 41. In this manner, the rotational force of the rotating shaft 20 is transmitted to the swash plate 40, and the swash plate 40 rotates.

In a case where the swash plate 40 is tilted, when the swash plate 40 rotates about the axis of the rotating shaft 20, rotary motion of the swash plate 40 is converted into linear motion of the piston 50 via the shoe 200. As a result, the piston 50 slides back and forth (reciprocates) in the cylinder bore 11*a*. When the piston 50 moves forward in the cylinder bore 11*a*, fluid is sucked into the cylinder bore 11*a*. When the piston 50 moves rearward in the cylinder bore 11*a*, the fluid in the cylinder bore 11*a* is compressed and discharged.

Next, a mechanism of titling the swash plate 40 will be described with reference to FIGS. 1 to 4.

The swash plate compressor 1 is configured such that the discharge capacity can be changed by titling the swash plate 40 (changing the tilting angle of the swash plate 40). The difference in internal pressure between the crank chamber 10*a* and the compression chamber 11*b* is adjusted by using the control valve 80. Thus, the tilting angle of the swash plate 40 is changed, and therefore the discharge capacity is controlled.

Specifically, when the internal pressure of the crank chamber 10*a* lowers, the swash plate 40 rotates clockwise as viewed from the left side. At this time, the connecting arm 110 rotates counterclockwise as viewed from the left side. Therefore, rotation (tilting) of the swash plate 40 can be appropriately guided. As a result, the tilting angle of the swash plate 40 is increased (see FIG. 3). Since the tilting angle of the swash plate 40 is increased, the discharge capacity of the swash plate compressor 1 is increased.

In contrast, when the internal pressure of the crank chamber 10*a* increases, the swash plate 40 rotates counter-clockwise as viewed from the left side. At this time, the connecting arm 110 rotates clockwise as viewed from the left side. Therefore, rotation (tilting) of the swash plate 40 can be appropriately guided. As a result, the tilting angle of the swash plate 40 is decreased (see FIG. 2). Since the tilting angle of the swash plate 40 is decreased, the discharge capacity of the swash plate compressor 1 is decreased.

Next, sliding between the shoe 200 and the swash plate 40 will be described with reference to FIGS. 5, 7(*a*), and 7(*b*).

When the swash plate 40 rotates in conjunction with rotation of the rotating shaft 20, the shoe 200 slides on the swash plate 40. More specifically, the second sliding surface 220 of the shoe 200 slides on the resin coating layer 42 formed on the plate surface of the swash plate 40.

Here, a wedge-shaped gap G is formed between the second sliding surface 220 and the resin coating layer 42 of the swash plate 40 (see FIG. 7(*b*)). The gap G is formed such that the angle between the second sliding surface 220 and the surface of the resin coating layer 42 of the swash plate 40 decreases smoothly toward the center of the second sliding surface 220. As a result, lubricant can be easily drawn from a large clearance to a small clearance. Therefore, oil film pressure can be generated between the second sliding surface 220 and the resin coating layer 42. Furthermore, since the bulging height h1 of the second sliding surface 220 is not greater than 15 μm, an oil film can be easily formed (easily maintained) between the second sliding surface 220 and the resin coating layer 42. Therefore, occurrence of seizure can be suppressed.

Here, since the central portion 222 having a substantially flat shape is provided on the second sliding surface 220, large contact area between the second sliding surface 220 and the resin coating layer 42 of the swash plate 40 can be secured. Therefore, the surface pressure between the second sliding surface 220 and the resin coating layer 42 is lower than that in a case where the central portion 222 is not provided. As a result, even if the member which slides on the second sliding surface 220 is a soft material such as the resin coating layer 42 of the swash plate 40, the resin coating layer 42 hardly deforms along to the shape of the second sliding surface 220 of the shoe 200. Therefore, even under high load, the wedge-shaped gap G can be maintained and occurrence of seizure can be suppressed.

As described above, the shoe 200 according to the present embodiment includes: the first sliding surface 210 which slides on the concave surface 53*a* of the piston 50 (the first movable member); and the second sliding surface 220 which bulges toward the side opposite to the first sliding surface 210 and slides on the flat surface of the swash plate 40 (the second movable member). The second sliding surface 220 includes the curved outer peripheral portion 221 which is provided along the outer periphery of the second sliding surface 220, and the central portion 222 which is provided at the center of the second sliding surface 220 so as to be continuous with the curved outer peripheral portion 221 and has the radius of curvature greater than a radius of curvature of the curved outer peripheral portion 221.

Such a configuration can suppress deformation of the swash plate 40.

In addition, the central portion 222 has the diameter of not less than 5 mm and the bulging height h2 of not greater than 3 μm.

Such a configuration can further suppress deformation of the swash plate 40.

In addition, the second sliding surface 220 has the bulging height h1 of not greater than 15 μm.

With such a configuration, even in the case of a severe lubrication condition in which the feed amount of lubricant is small, an oil film can be easily formed on the second sliding surface 220.

In addition, the swash plate compressor 1 according to the present embodiment includes the shoe 200 and the swash plate 40 which has the resin coating layer 42 provided on the flat surface.

With such a configuration, even if the resin coating layer 42 is formed on the flat surface of the swash plate 40, deformation of the swash plate 40 can be suppressed.

Note that the piston 50 according to the present embodiment is one mode of the first movable member according to the present invention.

In addition, the swash plate 40 according to the present embodiment is one mode of the second movable member according to the present invention.

The embodiment of the present invention has been described above; however, the present invention is not limited to the above configuration, and various modifications can be made within the scope described in the claims.

For example, in the present embodiment, the bulging height h1 of the second sliding surface 220 is not greater than 15 μm. However, the present invention is not limited to this, and the bulging height h1 may be greater than 15 μm.

In addition, in the present embodiment, the resin coating layer 42 is formed on the plate surface (flat surface) of the swash plate 40. However, the present invention is not limited to this, and the resin coating layer 42 may not be formed on the plate surface of the swash plate 40. In addition, the swash plate 40 may be made of a synthetic resin.

In addition, in the present embodiment, it has been described that the central portion 222 has a curved shape (spherical cap shape) whose radius of curvature is greater than that of the outer peripheral portion 221. However, a central portion 222 whose radius of curvature is ∞ (that is, the central portion 222 is a perfect plane) is included in the present invention.

INDUSTRIAL APPLICABILITY

The present invention can be applied to a shoe and a swash plate compressor including the shoe.

REFERENCE SIGNS LIST

1: Swash plate compressor
40: Swash plate
42: Resin coating layer
50: Piston
53*a*: Concave surface
200: Shoe
210: First sliding surface
220: Second sliding surface
221: Outer peripheral portion
222: Central portion

The invention claimed is:

1. A shoe comprising:

a first sliding surface which slides on a concave surface of a first movable member; and a second sliding surface which bulges toward a side opposite to the first sliding surface and slides on a flat surface of a second movable member, the second sliding surface is continuous with the first sliding surface, and the second sliding surface includes:

a curved outer peripheral portion which is provided along an outer periphery of the second sliding surface and includes an outer peripheral edge that meets the first sliding surface, a central portion which is provided at a center of the second sliding surface so as to be continuous with the curved outer peripheral portion and has a radius of curvature greater than a radius of curvature of the curved outer peripheral portion, and an angle between the second sliding surface and the flat surface of the second movable member decreases toward the central portion to form a wedge shaped gap, the wedge shaped gap being defined on one side by the radius of curvature of the curved outer peripheral portion, wherein the central portion has:

a diameter of not less than 5 mm, a bulging height of not greater than 3 μm measured from an apex of the central portion to an area where the central portion meets the curved outer peripheral portion, and a bulging height of not greater than 15 μm measured from the apex of the central portion to the outer peripheral edge.

2. A swash plate compressor comprising:

the shoe according to claim 1; and a swash plate which is the second movable member and has a resin coating layer provided on the flat surface of the second movable member.

* * * * *